US007069886B2

(12) United States Patent
Morin

(10) Patent No.: US 7,069,886 B2
(45) Date of Patent: Jul. 4, 2006

(54) VALVE CONTROL DEVICE FOR AN INTERNAL COMBUSTION ENGINE AND INTERNAL COMBUSTION ENGINE COMPRISING SUCH A DEVICE

(75) Inventor: Cédric Morin, Meudon (FR)

(73) Assignee: Pēugeot Citroen Automobiles SA, Villacoublay (FR)

( * ) Notice: Subject to any disclaimer, the term of this patent is extended or adjusted under 35 U.S.C. 154(b) by 0 days.

(21) Appl. No.: 10/947,685

(22) Filed: Sep. 23, 2004

(65) Prior Publication Data

US 2005/0081806 A1 Apr. 21, 2005

(30) Foreign Application Priority Data

Sep. 24, 2003 (FR) ..... 03 50605

(51) Int. Cl.
*F01L 9/04* (2006.01)

(52) U.S. Cl. ..... 123/90.11; 123/90.15; 251/129.1; 251/129.16

(58) Field of Classification Search ..... 123/90.11, 123/90.15; 251/129.16, 129.1
See application file for complete search history.

(56) References Cited

U.S. PATENT DOCUMENTS

| | | | | |
|---|---|---|---|---|
| 5,111,779 | A | 5/1992 | Kawamura | |
| 5,117,213 | A * | 5/1992 | Kreuter et al. | 335/219 |
| 6,279,523 | B1 | 8/2001 | Iida et al. | |
| 6,390,036 | B1 * | 5/2002 | Yuuki | 123/90.11 |
| 6,532,919 | B1 | 3/2003 | Curtis et al. | |
| 6,634,327 | B1 | 10/2003 | Yanai | |

FOREIGN PATENT DOCUMENTS

| | | |
|---|---|---|
| EP | 1 010 866 A | 6/2000 |
| FR | 2 784 497 A | 4/2000 |

* cited by examiner

*Primary Examiner*—Thomas Denion
*Assistant Examiner*—Zelalem Eshete
(74) *Attorney, Agent, or Firm*—RatnerPrestia

(57) ABSTRACT

The present invention pertains to a device for controlling a valve of an internal combustion engine, the device comprising an electromechanical actuator equipped with a magnet, and a processor controlling a defluxing current generating a magnetic field opposed to the magnetic field of the magnet, characterized in that it comprises means for controlling this defluxing current as a function of the open time of the valve and means for determining the rapidity of opening and/or closing of the valve from this open time, the controlled defluxing current ensuring the determined rapidity of opening and/or closing.

9 Claims, 4 Drawing Sheets

FIG.2a
PRIOR ART
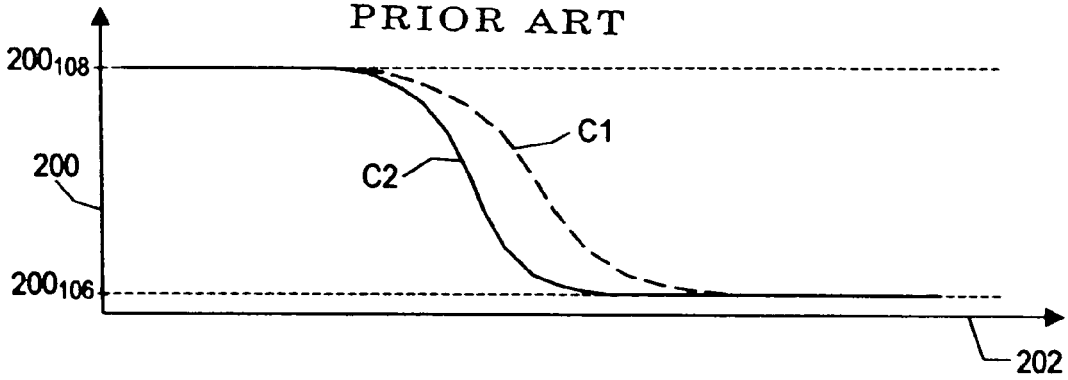
FIG.2b
PRIOR ART
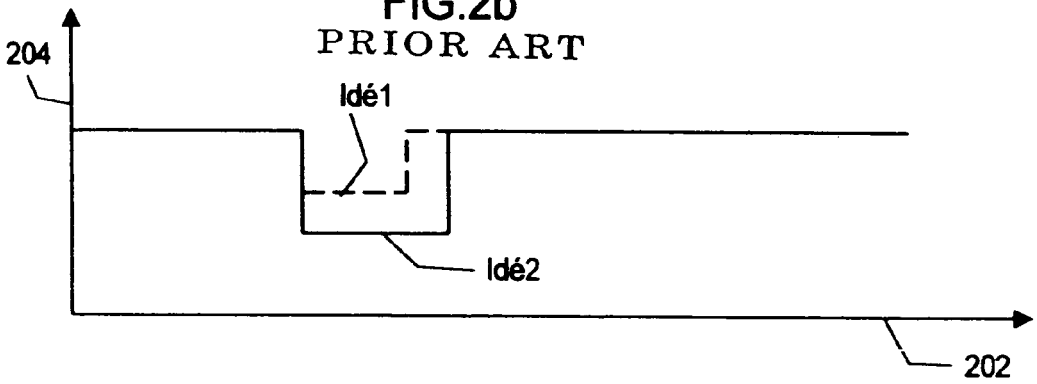
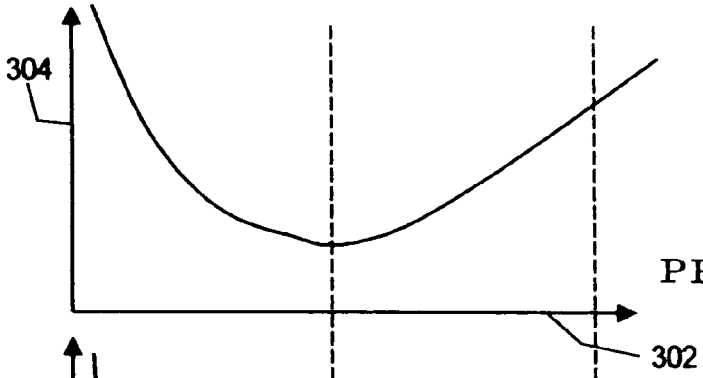
FIG.3
PRIOR ART
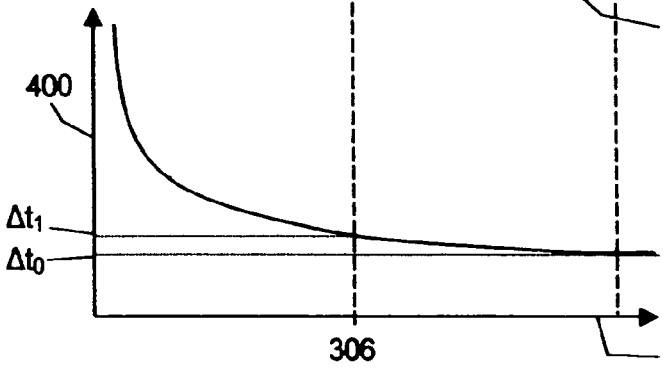
FIG.4
PRIOR ART

VALVE CONTROL DEVICE FOR AN INTERNAL COMBUSTION ENGINE AND INTERNAL COMBUSTION ENGINE COMPRISING SUCH A DEVICE

FIELD OF THE INVENTION

The present invention pertains to a valve control device for an internal combustion engine and to an internal combustion engine comprising such a device, especially for controlling a valve by means of an electromechanical actuator equipped with a magnet.

BACKGROUND

A device 100 (FIG. 1*a*) equipped with an electromechanical actuator 102 for a valve 110 comprises, in general, springs 102 and 103 and electromagnets 106 and 108 for controlling the position of the valve 110 by means of electric signals controlled by a processor 101.

More specifically, these electric signals comprise currents intended to generate magnetic fields that permit the valve 110 to be displaced or maintained in a given position.

The rod of the valve 110 is pressed for this purpose against the rod 112 of a magnetic plate 114 that is movable between the two electromagnets 106 and 108 in order for the plate to be displaced or maintained in such a position that the valve 110 is opened (FIG. 1*a*), permitting the admission of gas into the cylinder 117, or closed (FIG. 1*b*), blocking the admission of gas into the cylinder 117, depending on the magnetic fields to which the plate is subjected.

For example, the displacement of the valve 110 into an open position (FIG. 1*a*) is achieved by controlling an attracting current $I_{at}$ in the coil 107 of the electromagnet 106, which will then attract the plate 114 by means of a magnetic field $H_{at}$, the rod 112 of the plate displacing the valve 110 into the open position.

The actuator 102 may also be equipped with magnets 118 (electromagnet 108) and 116 (electromagnet 106), which latter is shown in FIG. 1*b*, the magnets being intended to optimize the operation of the device, especially by reducing the operating noise of the actuator and the energy necessary for the attraction and the maintenance of the plate 114 in a switched position.

Each magnet is located for this purpose on an electromagnet such that its magnetic field $H_{ai}$ holds the mobile plate against the electromagnet, as is shown in FIG. 1*a*.

Thus, the magnetic field $H_{ai}$ of the magnet participates in the attraction of the plate, and this magnetic field $H_{ai}$ consequently permits the plate 114 to be held against an electromagnet with a reduced or even zero holding current.

However, the use of a magnet 118 (FIG. 1*b*) has the drawback that when the plate 114 must move away from an electromagnet 108 equipped with the magnet 118 to control a switching of the valve 110, the magnetic field $H_{ai}$ generated by that magnet exerts a restoring force, which opposes this moving away, which interferes with the control of the valve 110, slowing down its displacement and completely preventing its transition.

To limit this drawback, it is known that a current $I_{dé}$ can be controlled, which is called a defluxing current and is intended to generate a magnetic field $H_{dé}$ that partially or completely compensates the magnetic field $H_{ai}$ generated by the magnet 118 of the electromagnet 108 such that the plate 114 is now subject to a weaker restoring force.

It should be noted that the defluxing current $I_{dé}$ has an opposite direction in the coils of an electromagnet compared with the direction of the attracting current $I_{at}$.

The effect of the defluxing current $I_{dé}$ on a valve switching will be described in detail below on the basis of FIG. 2*a*, which shows the location (ordinate 200, in mm) of the magnetic plate 114 between the two electromagnets 106 and 108 as a function of the time (abscissa 202, in msec), and of FIG. 2*b*, which shows the intensity and the duration of the defluxing current $I_{dé}$ (ordinate 204) flowing in the coil 109 of the electromagnet 108 as a function of the same chronology as in FIG. 2*a* (abscissa 202, in msec).

By comparing the rapidity of transition of the plate 114 from the electromagnet 108 ($\mathbf{200}_{108}$) to the electromagnet 106 ($\mathbf{200}_{106}$) for defluxing currents $I_{dé1}$ and $I_{dé2}$ of distinct intensity and duration, it is seen that the rapidity of the transition increases with increasing intensity and duration of the defluxing current.

Empirically, the transition shown by curve C1 drawn in dotted line using a current $I_{dé1}$ of a duration and intensity lower than those of current $I_{dé2}$ requires a longer time than the transition shown by curve C2 drawn in solid line, which is associated with this current $I_{dé2}$.

Consequently, a process control strategy should be defined in order to determine the defluxing current $I_{dé}$ furnishing the required valve control.

However, this defluxing current $I_{dé}$ also must be determined taking into account the energy consumption of the actuator in order to optimize this energy consumption.

Thus, as is shown in FIG. 3, the energy required by the defluxing current, shown on the abscissa 302, affects the electric energy consumption of the actuator (ordinate 304) such that an energy optimum 306 can be obtained for a switching time $\Delta t1$ (FIG. 4, ordinate 400, showing the switching time) longer than the minimum switching time $\Delta t_0$, which said minimum switching time $\Delta t_0$ requires a higher electric energy.

The deceleration of the valve to obtain a longer switching time than the optimum switching time $\Delta t_1$ also requires more energy.

This is why it is known that the intensity of the defluxing current $I_{dé}$ can be reduced as the speed decreases in order to optimize the controlled defluxing current.

Thus, the current consumption of the device is reduced at low engine speed, whereas the prolongation of the switching time of the valve can correspond to the longest engine cycle of a low-speed engine.

SUMMARY OF THE INVENTION

The present invention results from the observation that the control of the defluxing current as a function of the engine speed alone has the drawback of not permitting a good optimization of the operation of an actuator provided with an electromagnet.

Thus, the use of an actuator provided with an electromagnet makes it possible to control a valve as a function of numerous parameters other than the engine speed, for example, the pressure of the gases at the inlet into a cylinder, the rate of exhaust gas recycled in the admission gases, the amount of gas that has to be admitted into the cylinder, and/or the number of active valves.

Thus, equal open time of a valve can be obtained with a considerable number of operating states of the engine if this state of the engine is described only by the engine speed and/or the load of the engine.

For example, the deceleration of a vehicle from a high speed by the driver removing his foot from the gas pedal reduces the load to the minimum that can be reached as a function of the speed until a return to the idling engine speed.

Now, it is seen in this case that this deceleration is obtained with a variation of the speed and load, while the width of the valve diagram, or the applied open time of the valves is constant and corresponds to the minimum attainable width.

Inversely, at constant speed and load, a variation in the open time of an admission valve can be observed as a function of other parameters such as the admission pressure of the air, the number of active valves, and the number of active cylinders.

It is also necessary to take into account a considerable number of parameters describing the state of the engine in the defluxing current control optimization strategy, which makes the operation and the implementation of such a strategy as a function of the engine speed alone extremely complicated.

Finally, the present invention results from the observation that, as was described in detail above, the effect of the variation of the rapidity of opening and/or closing of a valve decreases with increasing duration of the time during which the valve is opened and/or closed.

This is why the present invention pertains to a valve control device for an internal combustion engine, the device comprising a processor controlling a defluxing current generating a magnetic field that is opposed to the magnetic field of the magnet, characterized in that it comprises means for controlling the defluxing current as a function of the open time of the valve and means for determining the rapidity of opening and/or closing of the valve based on its open time, the controlled defluxing current ensuring the determined rapidity of opening and/or closing.

Such a device has the advantage of controlling the defluxing current of the actuator as a function of the open time of the valve without regard to the manner in which it is determined, rather than as a function of the state of the engine, described, for example, by the engine speed, as disclosed by the prior art, thus optimizing the operation of the actuator.

In other words, considering the open time of the valve to control the defluxing current, the present invention makes it possible to use different strategies for controlling a valve without necessarily knowing the operation of the motor controlled by the valve.

Thus, as was described above, the open time of a valve does not describe the state of the engine and especially its speed.

As will be described below, the determination of the rapidity of opening and/or closing also makes it possible to minimize the energy consumption of the actuator, while corresponding to the energy needs of the engine.

According to one embodiment, the device comprises means for controlling the defluxing current by modifying its intensity and/or its duration.

In one embodiment, the device comprises means for determining the open time of the valve based on engine parameters such as the speed of the engine, the amount of air admitted into the cylinder in question, the pressure of the gas at the time of admission, the rate of recycling of the exhaust gases in the gases admitted, and the number of active admission valves per cylinder.

According to one embodiment, the magnet, located on an electromagnet of the actuator, ensures that the valve is maintained in an open or closed position without requiring a holding current.

In one embodiment, the actuator comprises two electromagnets, each electromagnet being equipped with a magnet, e.g., to ensure the maintenance of the valve in an open or closed position without requiring a holding current.

The present invention also pertains to an internal combustion engine equipped with a valve control device, the device comprising an electromechanical actuator equipped with a magnet, and a processor controlling a defluxing current generating a magnetic field that is opposed to the magnetic field of the magnet, characterized in that it comprises means for controlling the defluxing current as a function of the open time of the valve and means for determining the rapidity of opening and/or closing of the valve based on its open time, the controlled defluxing current ensuring the determined rapidity of opening and/or closing.

According to one embodiment, the engine comprises means for controlling the defluxing current by modifying its intensity and/or duration.

In one embodiment, the engine comprises means for determining the open time of the valve based on engine parameters such as the speed of the engine, the amount of air admitted into the cylinder in question, the pressure of the gases at the time of admission, the rate of recycling of the exhaust gases in the admission gas, and the number of active admission valves per cylinder.

BRIEF DESCRIPTION OF THE DRAWINGS

Other characteristics and advantages of the present invention will appear from the following illustrative and nonlimiting description given in reference to the figures attached, in which.

DETAILED DESCRIPTION

Figure 1A:
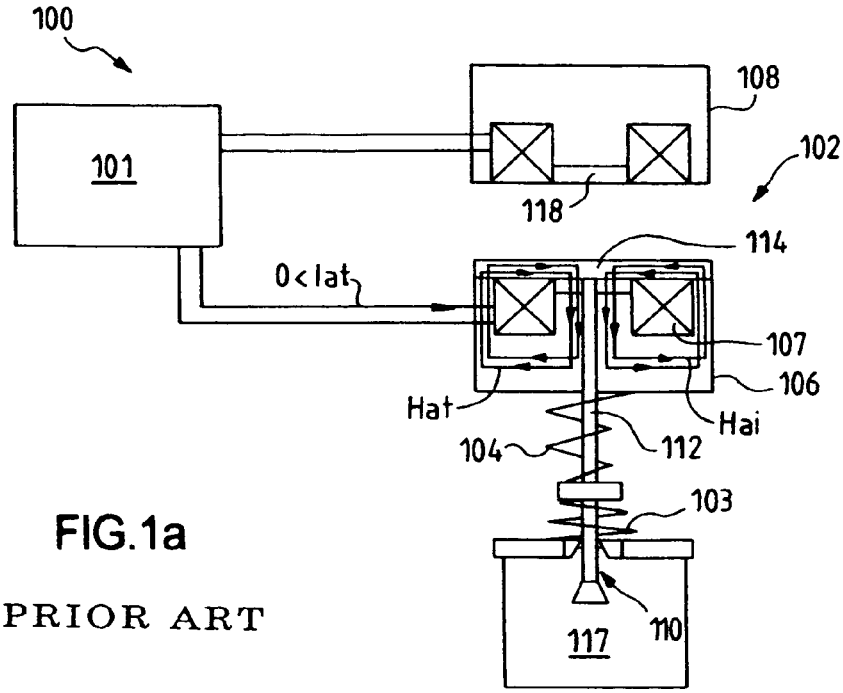
FIG.1a PRIOR ART
FIGS. 1*a* and 1*b*, already described, are schematic diagrams of a prior-art electromechanical actuator, FIGS. 2*a* and 2*b*, already described, show differences in the rapidity of switching of a controlled valve depending on distinct defluxing currents, FIG. 3, already described, is a curve showing the energy consumed by an actuator using a defluxing current, FIG. 4, already described, is a curve showing the switching time of a valve controlled by an actuator using a defluxing current.
Figure 1B:
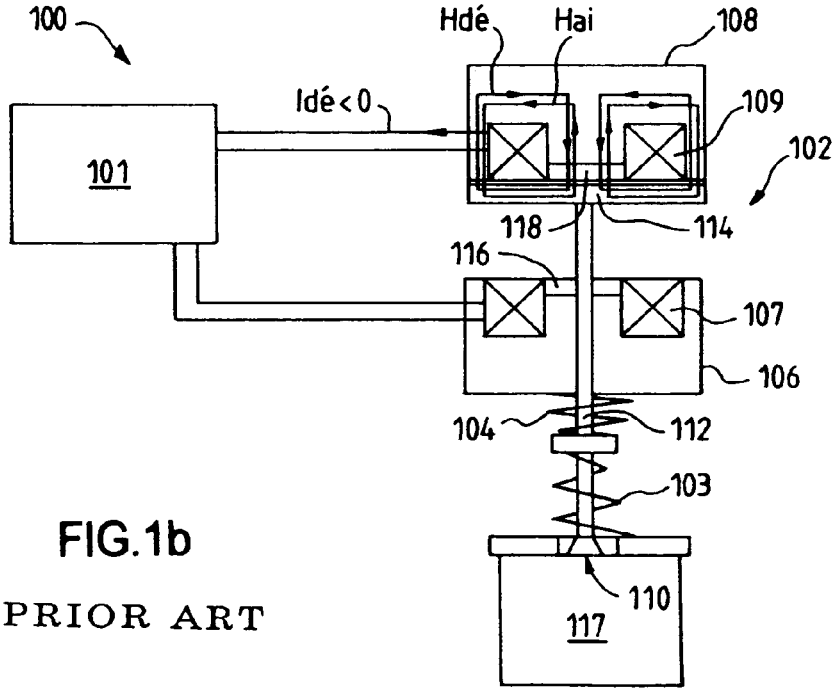
FIG.1b PRIOR ART
Figure 5:
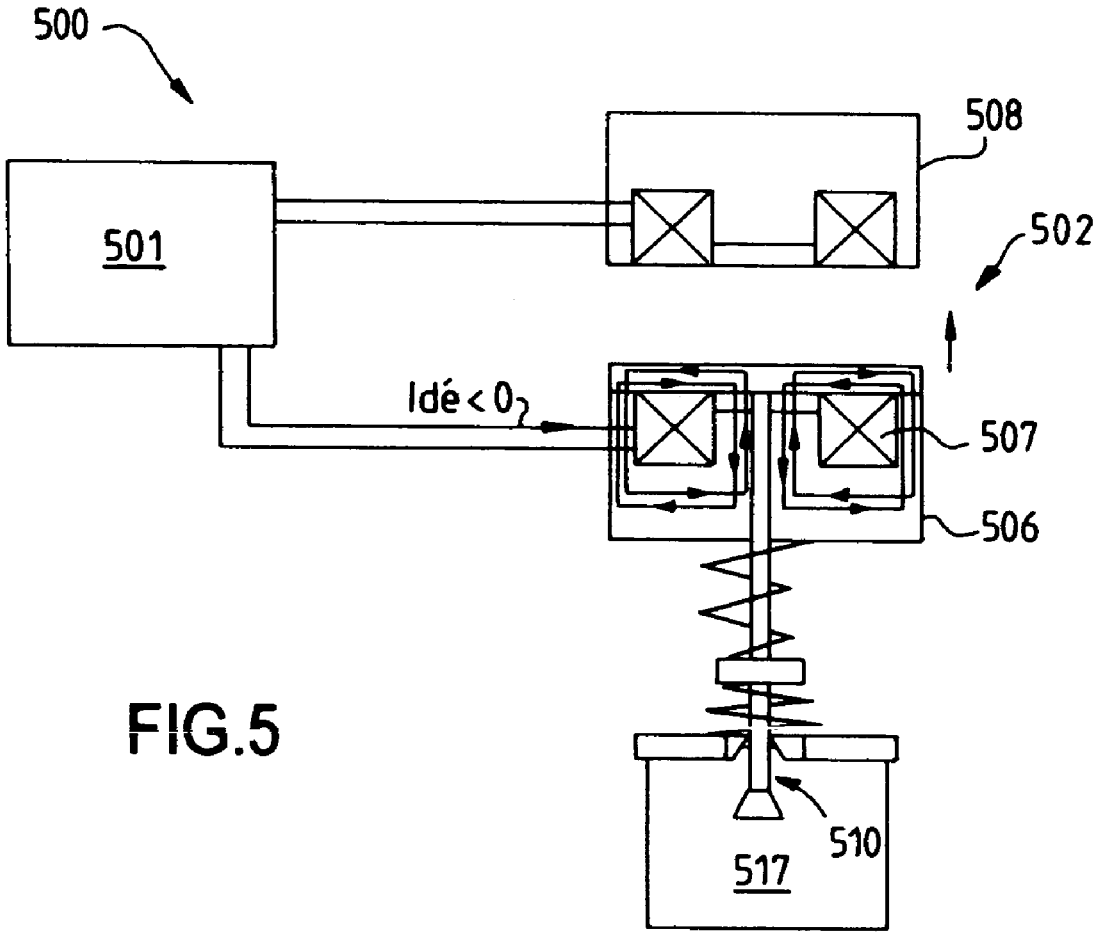
FIG. 5 shows a schematic diagram of a device according to the present invention.

The example of the device 500 (FIG. 5) according to the present invention, which will be described below, uses a processor 501 controlling the defluxing current flowing in the coil 507 of the electromagnet 506 of an actuator 502 of a valve 510.

From another processor (not shown) or internally, i.e., from the same processor 501, this processor 501 receives a command for opening the valve 510, which determines the moment and the duration of the opening.

Figure 6A:
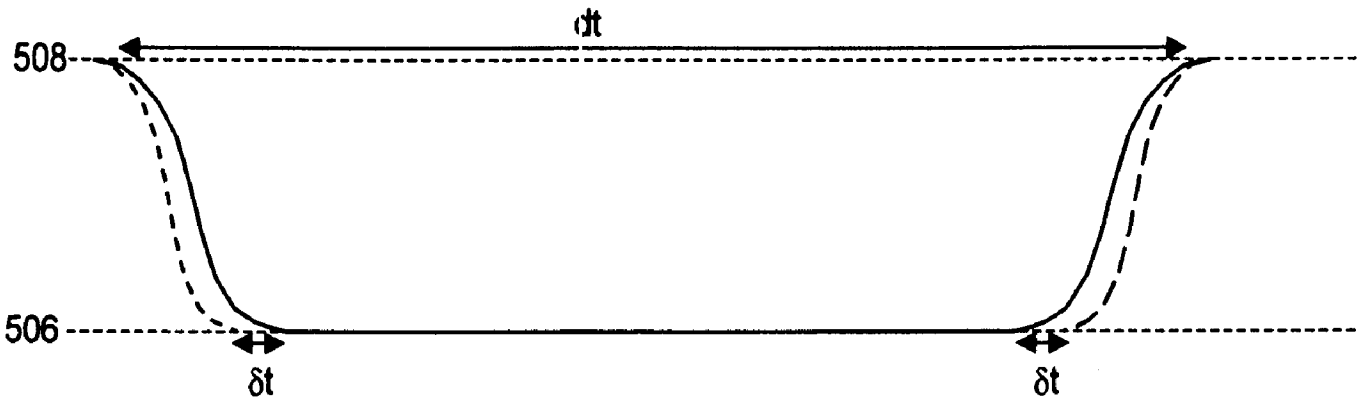
FIGS. 6*a* and 6*b* show the use of a defluxing current control according to the present invention.

Based on this open time, the processor 501 determines the rapidity with which the opening and/or closing of a valve must take place taking into account that, as will be described in detail below on the basis of FIGS. 6*a* and 6*b*, the rapidity required for opening a valve depends on the duration dt of opening of that valve.

The durations dt are shown considering a first defluxing current $I_{dé1}$ (curve drawn in dotted line) and a second defluxing current $I_{dé2}$ (curve drawn in solid line) of an intensity and duration that are lower than those of the first current $I_{dé1}$.

Figure 6B:
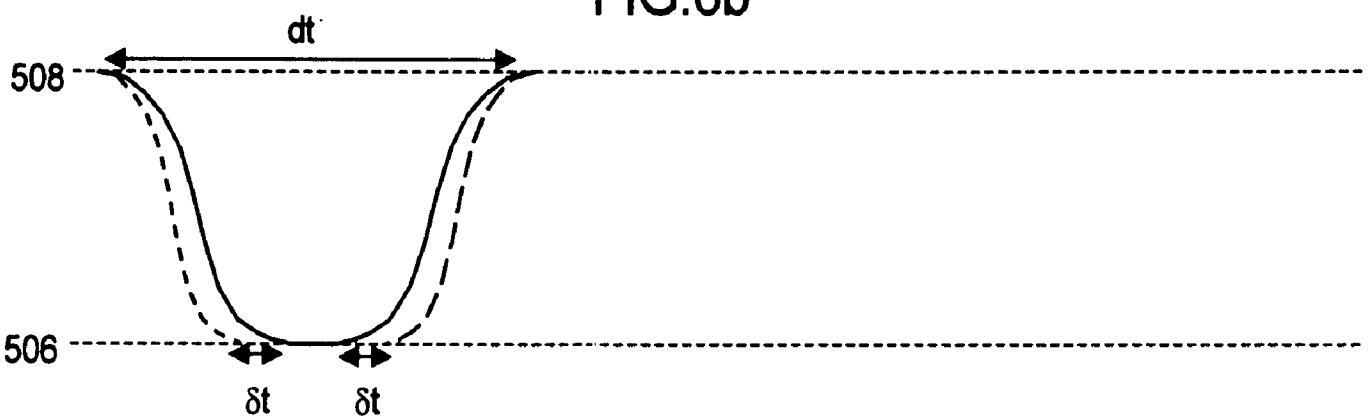

It appears that for a long open time dt (FIG. 6*a*), a change δt of the rapidity of opening and closing of the valve 510 has a lesser effect on the operation of the engine than when this valve open time dt is short (FIG. 6*b*).

This is why the processor 501 comprises in this embodiment means for determining the minimal rapidity of opening as a function of the open time determined for the valve, the minimal rapidity of opening making it possible to minimize the energy consumption of the actuator while still meeting the needs of the operation of the engine.

Now, knowing the minimal rapidity of opening and/or closing of the valve, the processor 501 can determine the defluxing current necessary for reaching this rapidity of opening, e.g., by means of mapping.

The present invention may have numerous variants. Thus, it is possible to use the present invention in various actuators comprising one or two electromagnets.

In this case, the present invention can be applied to an actuator whose only electromagnet is equipped with a magnet, the magnet permitting, for example, the valve to be maintained in the closed position.

Finally, the present invention may be used taking into account a magnet generating a magnetic field that is strong enough to maintain the valve in a fixed or switched position, regardless of the number of electromagnets equipped or not equipped with magnet(s).

The invention claimed is:

1. A device for controlling a valve of an internal combustion engine, the device comprising an electromechanical actuator equipped with a permanent magnet, and a processor controlling a defluxing current to generate a magnetic field opposed to the magnetic field of the permanent magnet, wherein the device comprises means for controlling the defluxing current as a function of an open time of the valve and means for determining a switching time of the valve from at least one of (a) an open state to a closed state or (b) the closed state to the open state, as a function of a duration during which the valve is opened, such that said defluxing current is controlled in order to minimize energy consumption of the device and to maximize said switching time while still meeting operational needs of the engine.

2. A device in accordance with claim 1, characterized in that it comprises means for controlling the defluxing current by modifying at least one of its intensity or its duration.

3. A device in accordance with claim 1 or 2, characterized in that it comprises means for determining the open time of the valve on the basis of engine parameters including at least one of speed of the engine, an amount of air admitted into the cylinder in question, a pressure of the gases at the time of admission, a rate of recycling of the exhaust gases in the admission gas, or a number of active admission valves per cylinder.

4. A device in accordance with claims 1 or 2, characterized in that the permanent magnet, located on a electromagnet of the actuator, ensures the maintenance of the valve in an open or closed position without requiring a holding current.

5. A device in accordance with claims 1 or 2, characterized in that, the electromechanical actuator comprises two electromagnets, each electromagnet being equipped with a permanent magnet, for example, to ensure the maintenance of the valve in an open or closed position without requiring a holding current.

6. An internal combustion engine equipped with a device for controlling a valve, the device comprising an electromechanical actuator equipped with a permanent magnet and a processor controlling a defluxing current to generate a magnetic field opposed to the magnetic field of the permanent magnet, wherein the engine comprises means for controlling the defluxing current as a function of an open time of the valve and means for determining a switching time of the valve from at least one of (a) an open state to a closed state or (b) the closed state to the open state, as a function of a duration during which the valve is opened, such that said defluxing current is controlled in order to minimize energy consumption of the device and to maximize said switching time while still meeting operational needs of the engine.

7. An engine in accordance with claim 6, characterized in that it comprises means for determining the rapidity of at least one of opening or closing of the valve from the open time of the valve, the controlled defluxing current ensuring the determined rapidity of the at least one of the opening or closing.

8. An engine in accordance with claim 6 or 7, characterized in that it comprises means for controlling the defluxing current by modifying at least one of an intensity or a duration thereof.

9. An engine in accordance with claims 6 or 7, characterized in that it comprises means for determining the open time of the valve from engine parameters including at least one of the speed of the engine, an amount of air admitted into a cylinder, a pressure of gases at the time of admission, a rate of recycling of the exhaust gases in the admission gas, or a number of active admission valves per cylinder.

* * * * *